US006588361B2

(12) United States Patent
Biedenweg

(10) Patent No.: US 6,588,361 B2
(45) Date of Patent: Jul. 8, 2003

(54) COVER FASTENING SYSTEM

(75) Inventor: Baron R. Biedenweg, Fort Wayne, IN (US)

(73) Assignee: Harris Kayot, Inc., Fort Wayne, IN (US)

( * ) Notice: Subject to any disclaimer, the term of this patent is extended or adjusted under 35 U.S.C. 154(b) by 0 days.

(21) Appl. No.: 09/732,239

(22) Filed: Dec. 7, 2000

(65) Prior Publication Data

US 2002/0069812 A1 Jun. 13, 2002

(51) Int. Cl.[7] ..... B63B 17/02; E04H 15/64

(52) U.S. Cl. ..... 114/361; 135/119

(58) Field of Search ..... 114/361; 135/88, 135/119; 160/368.1, 402; 296/100.16, 100.18

(56) References Cited

U.S. PATENT DOCUMENTS

| | | | | | |
|---|---|---|---|---|---|
| 2,784,781 | A | * | 3/1957 | Rhoades | 160/371 |
| 2,937,652 | A | * | 5/1960 | Zimmer, Jr. et al. | 135/124 |
| 2,961,725 | A | * | 11/1960 | McGee | 114/361 |
| 3,122,394 | A | | 2/1964 | Brydon | 296/120 |
| 3,172,419 | A | | 3/1965 | Lewis | 135/6 |
| 3,186,129 | A | | 6/1965 | Blood | 50/267 |
| 3,367,349 | A | * | 2/1968 | O'Link | 114/361 |
| RE26,363 | E | * | 3/1968 | Mills, II | 114/361 |
| 3,373,464 | A | * | 3/1968 | Ausnit | 24/586.1 |
| 3,426,400 | A | | 2/1969 | Lauro | 24/225 |
| 3,572,353 | A | | 3/1971 | Pinkley | 135/6 |
| 3,905,414 | A | * | 9/1975 | Guebert et al. | 160/330 |
| 4,158,244 | A | | 6/1979 | Stefan | 4/172.21 |
| 4,511,872 | A | * | 4/1985 | Olmsted et al. | 336/83 |
| 4,580,361 | A | | 4/1986 | Hillstrom et al. | 40/603 |
| 4,639,033 | A | | 1/1987 | Wheatley et al. | 296/100 |
| 4,756,107 | A | | 7/1988 | Hillstrom | 40/603 |
| 4,757,854 | A | * | 7/1988 | Rippberger | 160/391 |
| 5,058,652 | A | | 10/1991 | Wheatley et al. | 160/327 |
| 5,152,574 | A | | 10/1992 | Tucker | 296/100 |
| 5,215,032 | A | | 6/1993 | Ellis et al. | 114/361 |
| 5,331,993 | A | * | 7/1994 | Billbury | 135/119 |
| 5,343,824 | A | | 9/1994 | Floyd | 114/361 |
| 5,472,007 | A | * | 12/1995 | Malott | 135/88.1 |
| 5,553,652 | A | * | 9/1996 | Rushford | 160/354 |
| 5,660,219 | A | * | 8/1997 | Ford et al. | 160/38 |
| 5,702,147 | A | * | 12/1997 | Essig | 296/106 |
| 5,706,753 | A | | 1/1998 | Menne et al. | 114/361 |
| 5,788,315 | A | * | 8/1998 | Tucker | 296/100.16 |
| 5,970,904 | A | | 10/1999 | Wellen et al. | 114/361 |
| 5,984,379 | A | | 11/1999 | Michel et al. | 286/100.16 |
| 5,984,400 | A | * | 11/1999 | Miller et al. | 296/100.15 |
| 6,006,692 | A | * | 12/1999 | Szukhent, Jr. | 114/361 |

FOREIGN PATENT DOCUMENTS

| | | |
|---|---|---|
| GB | 2 198 396 | 6/1988 |

* cited by examiner

*Primary Examiner*—S. Joseph Morano
*Assistant Examiner*—Andrew Wright
(74) *Attorney, Agent, or Firm*—Baker & Daniels

(57) ABSTRACT

A cover fastening system for affixing a cover to an object, e.g., a boat. A generally U-shaped retaining clip is affixed to the cover and is sized to fit about and selectively engage an outwardly protruding portion of the boat. In one embodiment, the retaining clip engages an aluminum extruded rail positioned generally about the perimeter of the boat. The retaining clip includes a retaining clip hook and the outwardly extending portion of the boat includes a protrusion. The retaining clip hook engages the protrusion to hold the retaining clip in place. The retaining clip hook is preferably positioned on a leg of the generally U-shaped retaining clip, which, in use, maintains a generally horizontal position. With this configuration, a generally horizontal force may be applied to the retaining clip to operably position same and engage the retaining clip hook with the protrusion. The retaining clip is provided with a release handle so that application of force to the release handle will disengage the retaining clip hook from the protrusion and allow for removal of the boat cover. When used in conjunction with a boat, a plurality of retaining clips are spaced about the perimeter of the cover to allow for engagement of the cover generally about the perimeter of the boat.

11 Claims, 2 Drawing Sheets

COVER FASTENING SYSTEM

BACKGROUND OF THE INVENTION

1. Field of the Invention

The present invention relates to a fastening system for a cover, and, more particularly, to an improved fastening system for a boat cover which allows for quick and easy placement and removal of the boat cover.

2. Description of the Related Art

It is well known to provide a boat with a boat cover to prevent water and other debris from collecting inside the boat when the boat is not in use. In many instances, boats utilize covers designed to be affixed to the boat via a plurality of snaps. Typically, a plurality of male snap members are affixed to the outboard side of the boat, while a plurality of female snap members are affixed to the boat cover. The snap members are spaced about the entire perimeter of the cover to effect affixation thereof. For example, pontoon boats typically include a plurality of male snap members affixed to the outboard side of the rails forming the perimeter fencing of the pontoon boat.

Covers of this type (i.e., covers affixed by snaps) are relatively difficult to place in operative position. Many times the snap members are difficult to join together as well as to release. Additionally, the boat cover may shrink based upon climatic conditions. In these situations, the cover must be stretched for positioning about the boat since the snap members have a fixed spacing about the boat and the cover. Additionally, if the cover shrinks when affixed to the boat, removal will be made more difficult since the shrinking of the cover will exert forces on the snap connectors, which forces will be generally normal to the direction in which the snap connectors release.

Furthermore, rainwater frequently pools on a cover installed on a boat. The weight of such water can impede removal of the cover, as it will exert a force on the snap connectors in a direction generally normal to the direction in which the snap connectors release. Additionally, the significant weight of pooled rainwater may cause the boat cover to slip from the hands of the individual detaching the boat cover, causing the boat cover to fall inside of the boat, thereby depositing the pooled rainwater on the interior of the boat.

With the above disadvantages of snap connectors in mind, various alternative connecting mechanisms have been proposed. These connecting mechanisms include those utilizing cooperative pairs of hooks. In these embodiments, one of a pair of cooperative hooks is affixed to the boat cover, while the second of the pair of cooperative hooks is affixed to an outboard facing portion of the boat. The hooks are oppositely oriented so that, in use, each hook "hooks" the other such that each hook end is positioned internally in the body of the opposing hook. The vertical orientation of the hooks of this connecting mechanism necessitate tension in the cover to maintain engagement of the hooks. In these fastener arrangements, a portion of the boat cover extends past the hook affixed thereto and provides a gripping location for detachment of the cooperating hooks. To disengage the cooperating hooks and thereby disengage this cover affixing mechanism, the cover must be pulled downwardly so that the hook ends are displaced, one relative to the other. Pulling the cover downwardly to disengage this cover affixing mechanism is particularly difficult, e.g., when the cover has shrunk due to climatic conditions and/or rainwater has pooled on the cover. In both of these situations (i.e., cover shrinkage, or pooling of rainwater), a force acts on the boat cover opposite to the direction of displacement required to disengage the cooperating hooks.

What is needed in the art is a boat cover fastening system which allows for quick and easy placement and removal of a boat cover and which does not suffer from the disadvantages of the prior art outlined above.

SUMMARY OF THE INVENTION

The present invention provides an improved boat cover fastening system wherein it is desired to provide a boat cover fastening system which allows for quick and easy placement and removal of the boat cover and which does not require stretching of the boat cover to remove same. The current invention utilizes a generally U-shaped retaining clip affixed to the boat cover, which retaining clip is sized to fit about and selectively engage a portion of the boat. In one exemplary embodiment, the retaining clip includes a retaining clip hook, and the portion of the boat which is engaged by the retaining clip includes a protrusion. When the retaining clip is operably positioned to affix the cover to the boat, the retaining clip hook engages the protrusion to hold the retaining clip in place. The retaining clip hook is preferably positioned on a leg of the generally U-shaped retaining clip, which, in use, maintains a generally horizontal position. With this configuration, a generally horizontal force may be applied to the retaining clip to operably position the retaining clip and engage the retaining clip hook with the protrusion described above. The retaining clip is provided with a release handle so that application of force to the release handle will disengage the retaining clip hook from the protrusion and allow for removal of the boat cover. In this way, the boat cover can be quickly and easily removed without requiring stretching of same. The release handle for further be utilized to facilitate position of the retaining clip about the appropriate portion of the boat.

The invention, in one form thereof, comprises a cover fastening system including a fabric-like cover and a plurality of generally U-shaped retaining clips. The retaining clips are affixed to the cover and are operable to engage a structure on the covered object. Each of the retaining clips comprises an upper leg, a base, a lower leg, and a retaining clip hook. The base interconnects the upper leg and the lower leg to form the generally U-shaped retaining clip. The covered object includes a structure sized for placement of the retaining clip thereabout. The aforementioned structure includes a protrusion, with the retaining clip hook being sized for selective engagement with the protrusion. The retaining clip is engaged with the structure of the object to be covered, with the upper leg of the retaining clip contacting an upper surface of the structure, the lower leg of the retaining clip contacting a lower surface of the structure, the retaining clip hook engaging the protrusion, and the base of the retaining clip disposed in close proximity to a substantially vertical portion of the structure.

In one form of the current invention, the retaining clip hook is affixed to the lower leg of the retaining clip and the retaining clip hook further includes a release handle. In this form of the current invention, the release handle is operable to rotate the retaining clip hook out of engagement with the protrusion on the covered object and thereby allow for removal of the cover.

The invention, in another form thereof, comprises a boat and cover combination. The cover includes a plurality of retaining clips for selectively affixing the cover to the boat. The boat includes a structure sized for placement of the retaining clips thereabout. The retaining clips are generally U-shaped and selectively engage the aforementioned structure of the body of the boat. The structure is configured whereby generally horizontal movement of the retaining clips will engage the retaining clips with the structure.

An advantage of the present invention is the ability to provide a boat cover fastening system which allows for easy application and removal of a boat cover.

Another advantage of the present invention is the ability to provide a boat cover fastening system which does not require the boat cover to be stretched for removal thereof.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 5:
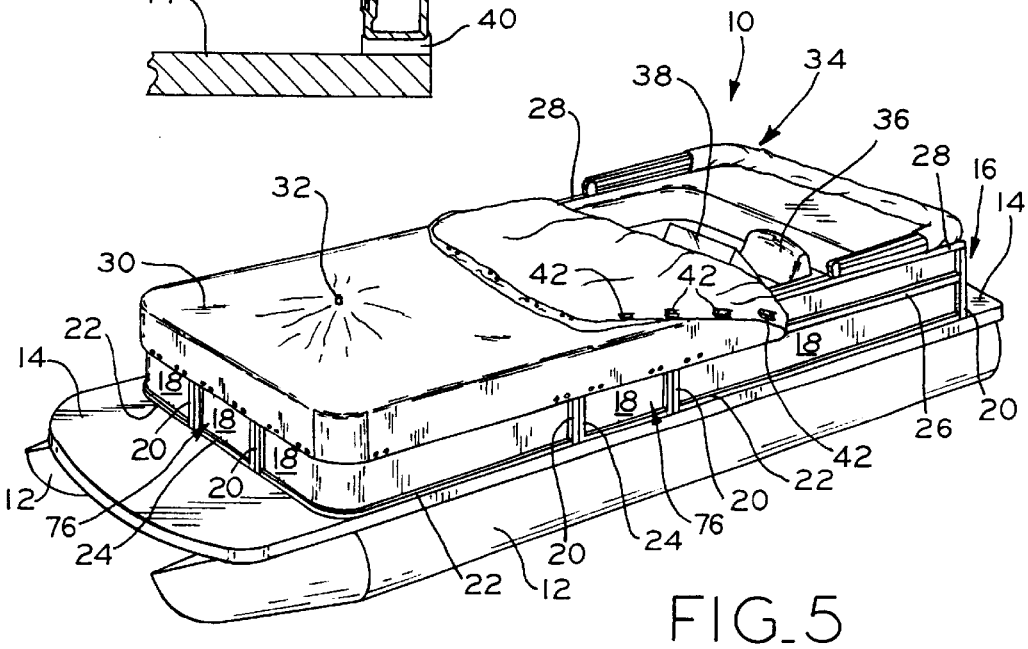
FIG. 5 is a perspective view of a pontoon boat illustrating partial attachment of a boat cover utilizing the cover fastening system of the current invention.

Referring now to the drawings and particularly to FIG. 5, there is illustrated pontoon boat 10 including flotation tubes 12, deck 14, and fence 16. As illustrated, fence 16 generally surrounds the perimeter of boat 10 and encloses the seating area of boat 10. In the seating area, captain's chair 36, console 38, and a plurality of seating surfaces (not shown) can be found. The current invention provides a system for fastening cover 30 about fence 16 such that the entire seating area is covered and protected from the elements. As illustrated in FIG. 5, boat 10 includes bipositionable bimini top 34. Top 34 is illustrated in its stored, lowered position. Prior to covering boat 10, top 34 may be positioned in an upright (but unopened) position, with cover 30 including apertures through which the support members of top 34 will pass.

Figure 4:
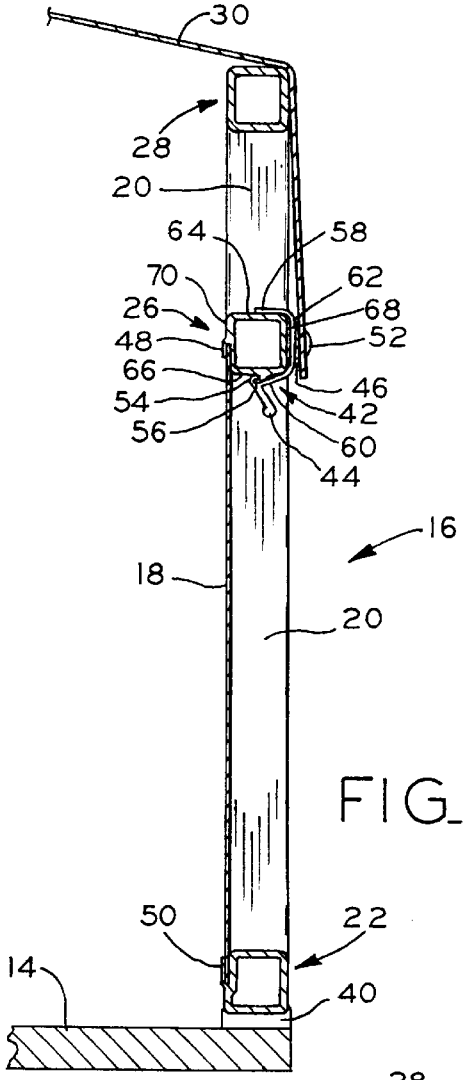
FIG. 4 is a fragmentary end elevational view of a section of a pontoon boat with a cover affixed thereto utilizing a retaining clip and cooperating rail in accordance with the present invention.

As illustrated in FIG. 5, fence 16 is formed from upright fence rails 20, lower lateral rails 22, intermediate lateral rails 26, and upper lateral rails 28, with fence panels 18 being positioned between intermediate lateral rails 26 and lower lateral rails 22. Upright fence rails 20, lower lateral rails 22, intermediate lateral rails 26, and upper lateral rails 28 comprise aluminum extruded rails. Referring now to FIG. 4, fence panel retainers 48, 50 are utilized to maintain the position of fence panels 18 between intermediate lateral rails 26 and lower lateral rails 22. Further, as illustrated in FIG. 4, spacer 40 may be provided between lower lateral rails 22 and deck 14. Fence 16 includes doors 76 formed therein. Doors 76 are formed in fence 16 by door frames 24 surrounding sections of fence panel 18. Door frames 22 are hingedly connected to upright fence rails 20 and allow for entry on to and exit off from boat 10.

As illustrated in FIG. 5, "playpen" style cover 30 includes support pole location 32 beneath which a support pole is positioned between cover 30 and deck 14. While only a single support pole area 32 is illustrated, typical arrangements include a plurality of support pole areas and corresponding support poles designed to raise the central portion of the boat cover so that precipitation contacting cover 30 will tend to be directed away from the center of boat 10. As indicated in the background section, precipitation can pool on a boat cover. This occurs when low spots develop between fence 16 and support pole locations 32.

Figure 1:
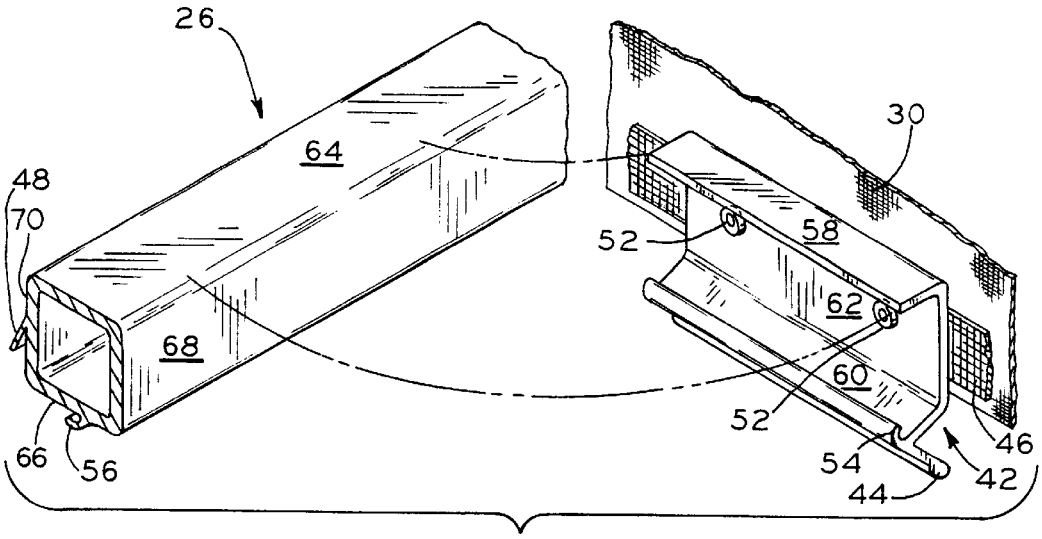
FIG. 1 is a fragmentary, exploded, perspective view illustrating a retaining clip and cooperating boat rail in accordance with the present invention.

Referring now to FIG. 1, a portion of intermediate lateral rail 26 is illustrated. Intermediate lateral rail 26 includes top 64, bottom 66, outboard side 68, and inboard side 70. Bottom 66 of intermediate lateral rail 26 includes elongate rail hook 56. Affixed to cover 30 is retaining clip 42. Retaining clip 42 is generally U-shaped and, in one exemplary embodiment, comprises a vinyl extrusion having relatively stiff elastic properties. Retaining clip 42 includes upper leg 58, lower leg 60, and base 62. Lower leg 60 of retaining clip 42 includes retaining clip hook 54 and release handle 44. Cover 30 is affixed to retaining clip 42 via rivets 52. Reinforcing material 46 is positioned between retaining clip 42 and cover 30 and functions to reinforce the affixment of cover 30 to retaining clip 42 and to discourage tears in cover 32. Affixation of retaining clip 42 to cover 30 with rivets 52 advantageously allows for easy replacement of a broken retaining clip. If a retaining clip is damaged, the rivets can be disengaged to allow for removal of the damaged retaining clip for replacement thereof.

Figure 2:
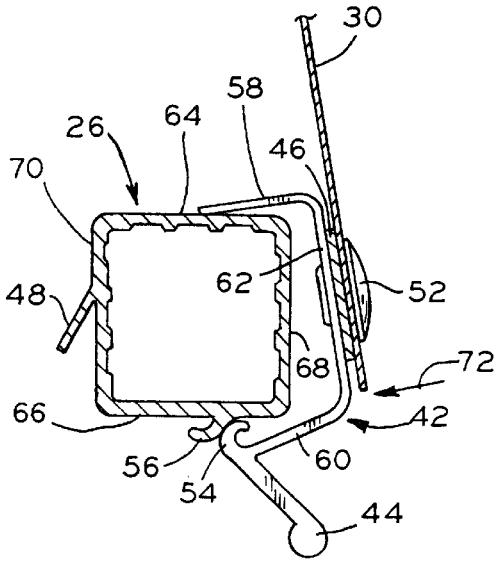
FIG. 2 is a fragmentary end elevational view illustrating positioning of a retaining clip of the present invention prior to affixation to a boat rail in accordance with the present invention.
Figure 3:
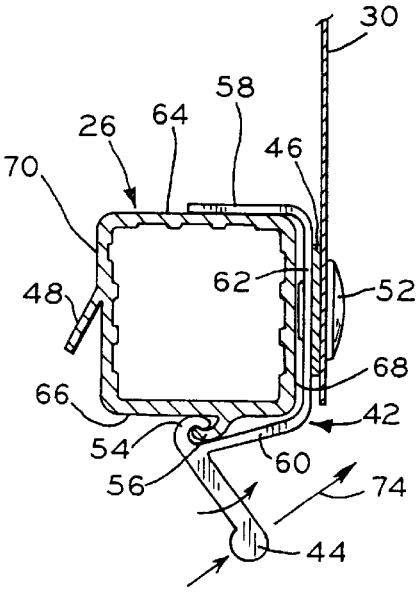
FIG. 3 is a fragmentary end elevational view as in FIG. 2, illustrating affixment of the retaining clip to the boat rail.

Turning now to FIG. 2, cover 30 is operably affixed to intermediate lateral rail 26 by positioning upper leg 58 of retaining clip 42 on top 64 of intermediate lateral rail 26. As illustrated in FIG. 2, retaining clip hook 54 abuts rail hook 56 just prior to affixation of retaining clip 42 to intermediate lateral rail 26. To complete positioning of retaining clip 42 about intermediate lateral rail 26, horizontal force is applied at the general location and direction indicated at 72. When force is applied in this manner, retaining clip hook 54 rides over rail hook 56 and achieves a fixed position as illustrated in FIG. 3. Rail hook 56 could be replaced by another protrusion sized to be engaged by retaining clip hook 54. Removal of retaining clip 42 from engaged relationship with intermediate lateral rail 26 is effected by application of force to release handle 44 at the general location and direction indicated at 74. As force is applied (at 74) to release handle 44, retaining clip hook 54 is generally rotated (as is release handle 44) about a point formed by the intersection of release handle 44 and lower leg 60 of retaining clip 42. As retaining clip hook 54 is rotated, it is disengaged from rail hook 56. Optimally, force is applied to the distal most portion of release handle 44 to increase the moment arm and facilitate release of retaining clip hook 54 from engagement with rail hook 56. Upon disengagement of the retaining clips, cover 30 can be removed from boat 10. Force may also be applied at the general location and direction indicated at 74 to facilitate placement of retaining clip 42 about intermediate lateral rail 26.

While this invention has been described as having a preferred design, the present invention can be further modified within the spirit and scope of this disclosure. This application is therefore intended to cover any variation, uses, or adaptations of the invention using its general principles. Further, this application is intended to cover such departures from the present disclosure as come within known or customary practice in the art to which this invention pertains and which fall within the limits of the appended claims.

What is claimed is:

1. A cover and covered object combination, comprising:

a fabric-like cover;

a plurality of generally U-shaped retaining clips affixed to said cover, each said retaining clip comprising:

an upper leg;

a base;

a lower leg, whereby said base interconnects said upper leg and said lower leg to form said generally U-shaped retaining clip; and a retaining clip hook;

the covered object including a structure sized for placement of said retaining clips thereabout; said structure including a protrusion; each said retaining clip hook sized for selective engagement with said protrusion; each said retaining clip engaged with said structure, with each said upper leg contacting an upper surface of said structure, each said lower leg contacting a lower surface of said structure, each said retaining clip hook engaging said protrusion, and each said base disposed in close proximity to a substantially vertical portion of said structure, wherein said protrusion comprises a hook, and wherein each said retaining clip further includes a release handle connected to said retaining clip hook and operable to rotate said retaining clip hook out of engagement with said protrusion and thereby allow for removal of the cover.

2. The combination of claim 1, wherein the covered object comprises a boat, and wherein said structure sized for placement of said retaining clip thereabout comprises a rail.

3. The combination of claim 1, wherein said protrusion is formed on said lower surface of said structure, and wherein each said retaining clip hook is formed on said lower leg of each said retaining clip.

4. The combination of claim 1 further comprising a plurality of rivets, at least one of said rivets affixing said cover to each said retaining clip.

5. A boat and cover combination, comprising:

a boat;

a cover including a plurality of retaining clips for selectively affixing said cover to said boat, whereby said boat includes a structure sized for placement of said retaining clips thereabout, said retaining clips being generally U-shaped, said structure being configured whereby generally horizontal movement of said retaining clips will engage said retaining clips with said structure, wherein said structure includes a protrusion on a bottom surface thereof, said bottom surface spanning an inboard point and an outboard point, said protrusion disposed laterally in an outboard direction from said inboard point and wherein each said retaining clip includes a retaining clip hook on a lower leg thereof, said retaining clip hooks sized for selective engagement with said protrusion, and wherein each said retaining clip further includes a release handle connected to said retaining clip hook and operable to rotate said retaining clip hook out of engagement with said protrusion and thereby allow for removal of the cover.

6. The combination of claim 5, wherein said boat comprises:

a pair of flotation tubes;

a deck operably positioned atop said flotation tubes; and a fence positioned generally about the perimeter of the boat;

whereby said fence includes a plurality of lateral rails, said lateral rails comprising said structure sized for placement of said retaining clip thereabout; and whereby said cover is selectively affixable to said fence to cover said boat.

7. The combination of claim 5, wherein each said retaining clip comprises:

an upper leg;

a base; and a lower leg, whereby said base interconnects said upper leg and said lower leg to form said generally U-shaped retaining clip;

wherein said structure of said boat comprises:

a top;

a bottom; and an outboard side;

whereby each said upper leg of each said retaining clip engages said top of said structure, each said lower leg of each said retaining clip engages said bottom of said structure, and each said base is disposed in close proximity to said outboard side of said structure to affix said cover to said boat.

8. A cover and covered object combination, comprising:

a fabric-like cover;

a plurality of generally U-shaped retaining clips non-releasably secured to said cover, each said retaining clip comprising:

an upper leg;

a base;

a lower leg, whereby said base interconnects said upper leg and said lower leg to form said generally U-shaped retaining clip; and a retaining clip hook;

the covered object including a structure sized for placement of said retaining clips thereabout; said structure including a protrusion; each said retaining clip hook sized for selective engagement with said protrusion; each said retaining clip engaged with said structure, with each said upper leg contacting an upper surface of said structure, each said lower leg contacting a lower surface of said structure, each said retaining clip hook engaging said protrusion, and each said base disposed in close proximity to a substantially vertical portion of said structure; and wherein each said retaining clip further includes a release handle connected to said retaining clip hook and operable to rotate said retaining clip hook out of engagement with said protrusion and thereby allow for removal of the cover.

9. The combination of claim 8, wherein the covered object comprises a boat, and wherein said structure sized for placement of said retaining clip thereabout comprises a rail.

10. The combination of claim 8, wherein said protrusion is formed on said lower surface of said structure, and wherein each said retaining clip hook is formed on said lower leg of each said retaining clip.

11. The combination of claim 8, further comprising a plurality of rivets, at least one of said rivets affixing said cover to each said retaining clip.

* * * * *